United States Patent [19]

Niess

[11] Patent Number: 4,484,453

[45] Date of Patent: Nov. 27, 1984

[54] AMMONIA PLANT REFRIGERATION SYSTEM AND PROCESS CONTROL METHOD THEREFOR

[75] Inventor: Joseph Niess, Donaldsonville, La.

[73] Assignee: CF Industries, Inc., Long Grove, Ill.

[21] Appl. No.: 433,543

[22] Filed: Oct. 8, 1982

[51] Int. Cl.[3] ..... F25B 43/04

[52] U.S. Cl. ..... 62/195; 62/228.4; 62/475

[58] Field of Search ..... 62/195, 85, 475, 228.3, 62/228.4; 236/1 EA

[56] References Cited

U.S. PATENT DOCUMENTS

| | | | |
|---|---|---|---|
| 2,321,964 | 6/1943 | Zieber | 62/195 |
| 2,920,458 | 1/1960 | Watkins | 62/195 |
| 3,404,072 | 10/1968 | Bollen et al. | 203/1 |
| 3,513,662 | 5/1970 | Golber | 236/1 EA |
| 3,600,283 | 8/1971 | Bollen et al. | 203/1 |
| 3,668,883 | 6/1972 | Ruff et al. | 62/228.4 |
| 3,803,863 | 4/1974 | Jedacz et al. | 62/209 |
| 4,325,223 | 4/1982 | Cantley | 62/475 |

OTHER PUBLICATIONS

Hydrocarbon Processing, Nov. 1981, Ammonia.

*Primary Examiner*—William E. Wayner

*Attorney, Agent, or Firm*—Trexler, Bushnell & Wolters, Ltd.

[57] ABSTRACT

A method for maintaining a preselected concentration of non-condensible gases in a condenser is disclosed. A compressor supplies the condenser with compressed ammonia. The compressed ammonia includes non-condensible gases. At least a portion of the compressed ammonia condenses, forms condensed ammonia and exits the condenser. A pressure controller operates an automatic valve to vent at least a portion of the non-condensible gases from the condenser. A temperature element senses the condensed ammonia temperature and sends a signal, based upon the condensed ammonia temperature, to the pressure controller. The pressure controller uses the signal to reduce the pressure of the condenser from a predetermined value to a computed value estimated to be necessary to maintain the preselected concentration of non-condensible gases in the condenser. The pressure controller also senses actual pressure in the condenser, compares such actual pressure to the computed value of pressure and makes adjustments to the automatic valve until the actual pressure in the condenser is approximately equal to the computed value. The effect of maintaining the preselected concentration of non-condensible gases is to minimize energy requirements of the compressor over time.

6 Claims, 1 Drawing Figure

AMMONIA PLANT REFRIGERATION SYSTEM AND PROCESS CONTROL METHOD THEREFOR

BACKGROUND OF THE INVENTION

This invention is directed to a method of process control. More particularly, this invention is directed to a method for effecting energy savings in relation to a refrigeration system of an ammonia production plant.

It is perhaps all too well known that ammonia production is currently an energy-intensive industry. It is also widely recognized that the cost of such energy, although not burgeoning at the rate of a decade ago, is currently a major portion of the total cost of ammonia production. Accordingly, small increases in ammonia production efficiency, effected by more efficient use of energy, can have significant impact in reducing ammonia production costs.

In certain ammonia production plant refrigeration systems (see, for example, *Hydrocarbon Processing* Magazine, published by Gulf Publishing Company, Vol. 60, No. 11, pp. 129–132, November, 1981), product ammonia is used as refrigerant in a refrigeration system of the ammonia production facility. The refrigeration system usually includes a condenser. Compressed product ammonia is introduced into the condenser and therein is cooled by a cooling medium, usually cooling-tower water.

Product ammonia usually contains dissolved non-condensible gases, such as nitrogen, methane, hydrogen, argon and helium, for example, which accumulate in the condenser as non-condensibles. Such non-condensibles are usually selectively purged from the condenser by a purge stream. The purge stream flow is usually adjusted to maintain a predetermined pressure in the condenser.

The temperature of the cooling medium being introduced into the condenser affects the temperature of the cooled product ammonia exiting the condenser. If the condensing temperature of the product ammonia remains fixed, and if the pressure within the condenser is held constant, the percentage of non-condensibles in the condenser will also remain constant. However, in a conventional ammonia production plant, the condensing temperature of the product ammonia does not remain fixed because of seasonal changes of the temperature of the cooling medium being supplied to the condenser.

Conventional ammonia production plant refrigeration systems use a pressure controller to maintain condenser pressure at a predetermined value. Such a predetermined pressure value may or may not be adjusted periodically between summer and winter conditions.

If the condensing temperature of the product ammonia changes, and if pressure in the condenser is held constant, the percentage of non-condensibles in the condenser will vary according to a well-known relationship, wherein the sum of a first and second fraction is always equal to 1: the first fraction is the ratio of the vapor pressure of the product ammonia, in the condenser at the condenser operating temperature, to the absolute pressure in the condenser; the second fraction is the converted value of the percentage of non-condensibles, in relation to the product ammonia in the vapor phase in the condenser. From the above relationship, it will be noted, by those skilled in the art, that as the condensing temperature, for the ammonia, is lowered and as the pressure in the condenser is held constant, the relative percentage of non-condensibles increases in the vapor phase in the condenser.

For example, my calculation indicates that in an ammonia refrigeration system designed for a 95° Fahrenheit (35° Centigrade) cooling medium temperature to the condenser and a 100° Fahrenheit (37.8° Centigrade) temperature for the product ammonia exiting the condenser at a 223 pounds per square inch absolute (15.68 kilograms per square centimeter absolute) pressure within the condenser, the concentration of non-condensibles in the condenser would be about 5%. If the cooling medium were then reduced to 60° Fahrenheit (15.6° Centigrade) and the condensing product ammonia temperature exiting the condenser were then reduced to 65° Fahrenheit (18.3° Centigrade) at the 223 pounds per square inch pressure condition within the condenser, my calculations, for this example, indicate that the concentration of non-condensibles in the condenser would increase to about 47%.

In calculations of this type, it is standard engineering practice to assume a temperature differential of about 5° Fahrenheit (about 2.8° Centigrade), as the temperature of approach. This means that the coldest temperature obtainable by the fluid to be cooled (in the above example, the compressed product ammonia) is about 5° Fahrenheit (about 2.8° Centigrade) more than the temperature of the cooling medium entering the condenser.

My calculations further indicate that if the condenser pressure at the 65° Fahrenheit (18.3° Centigrade) temperature condition for the product ammonia exiting the condenser were reduced to 124 pounds per square inch absolute (8.72 kilograms per square centimeter absolute), the concentration of non-condensibles would be about 5% in the condenser.

The refrigeration system of the ammonia production system also usually includes a compressor which, by compressing the product ammonia being introduced into the condenser, causes the condenser to be pressurized. The calculated effect of the reduction of condenser operating pressure from 223 pounds per square inch absolute (15.68 kilograms per square centimeter absolute) to 124 pounds per square inch absolute (8.72 kilograms per square centimeters absolute) is to reduce the compression power required, by approximately 13%.

OBJECTS AND SUMMARY OF THE INVENTION

Accordingly, it is a general object of this invention to provide a new and improved method of process control.

A more specific object is to provide a new method for controlling an ammonia plant refrigeration system, which reduces energy consumption for compression by adjusting pressure within a condenser to compensate for changes in the temperature of the cooling medium being supplied to the condenser.

Briefly, and in accordance with the foregoing objects, a method for maintaining a preselected concentration of non-condensible gases in a condenser will now be summarized. A compressor supplies the condenser with compressed ammonia. The compressed ammonia includes non-condensible gases. At least a portion of the compressed ammonia condenses, forms condensed ammonia and exits the condenser. A pressure controller operates an automatic valve to vent at least a portion of the non-condensible gases from the condenser. A temperature element senses the condensed ammonia temperature and sends a signal, based upon the condensed ammonia temperature, to the pressure controller. The pressure controller uses the signal to reduce the pressure of the condenser from a predetermined value to a computed value estimated to be necessary to maintain the preselected concentration of non-condensible gases in the condenser. The pressure controller also senses actual pressure in the condenser, compares such actual pressure to the computed value of pressure and makes adjustments to the automatic valve until the actual pressure in the condenser is approximately equal to the computed value.

The effect of maintaining the preselected concentration of non-condensible gases is to minimize energy requirements of the compressor over time.

BRIEF DESCRIPTION OF THE DRAWINGS

The foregoing, as well as other objects, features and advantages of the present invention will become more readily understood upon reading the following detailed description of the illustrated embodiment, together with reference to the drawing, wherein.

DETAILED DESCRIPTION OF THE ILLUSTRATED EMBODIMENT

Figure 1:
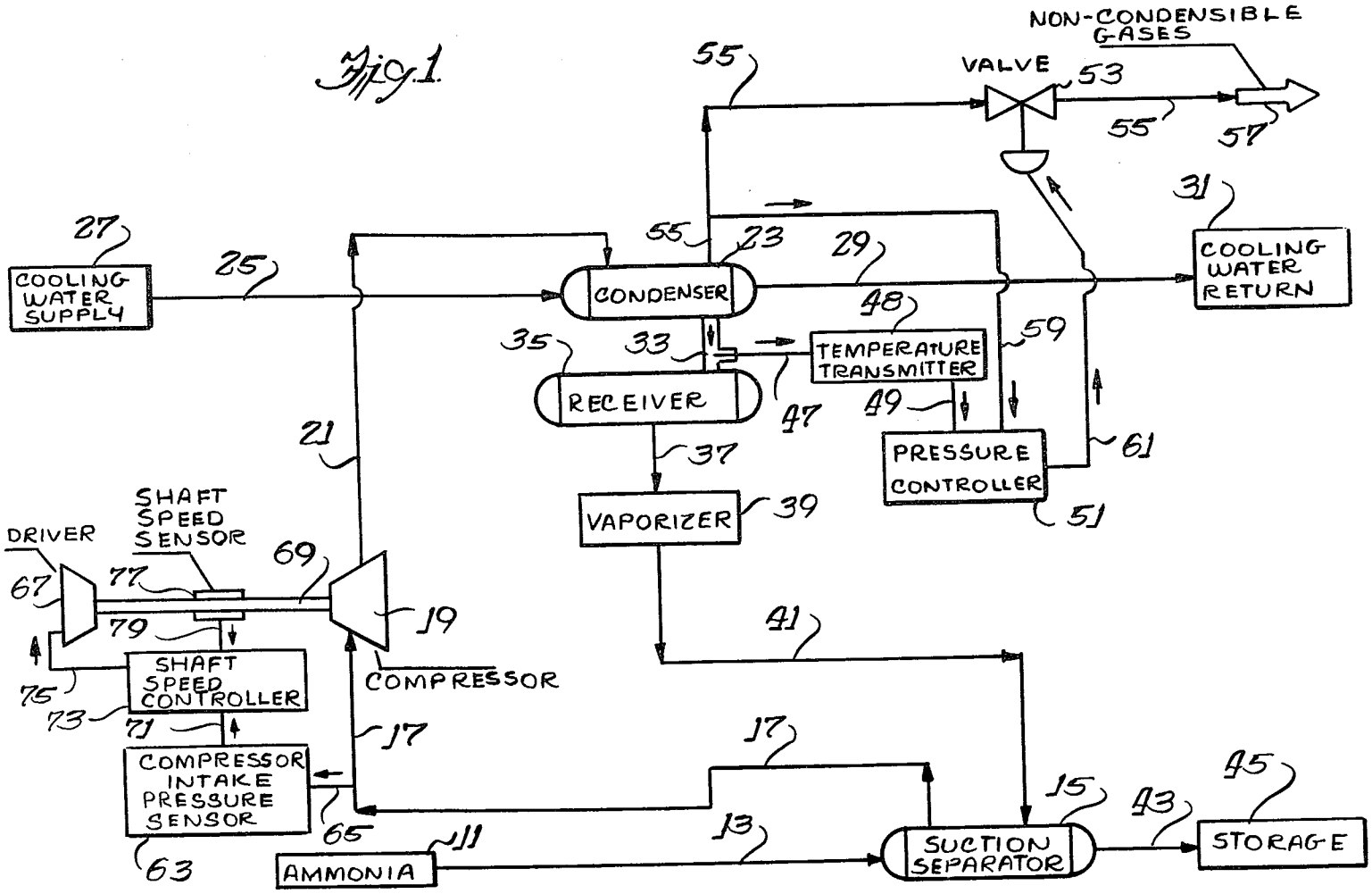
FIG. 1 is a schematic presentation of a refrigeration system of an ammonia production plant which incorporates the invention.

Referring now to the schematic drawing, ammonia, from a source 11 is supplied by a conduit 13 to a suction separator 15. At least a portion of the ammonia being supplied to the separator 15 is conveyed from the separator 15 via a conduit 17 and into an intake port of a compressor 19. The compressor 19 first compresses the ammonia and thereafter exhausts the compressed ammonia out of a discharge port of the compressor 19 and into a conduit 21 which conveys the compressed ammonia into a condenser 23.

The ammonia being supplied to the compressor 19 includes a variety of gases, such as nitrogen, methane, hydrogen, argon and helium, for example, which are also compressed by the action of the compressor 19, but which are not condensed in the condenser 23. In this sense, such gases are referred to as non-condensible gases, or simply as non-condensibles.

The compressing action of the compressor 19 heats the ammonia and non-condensibles. Cooling water, which is supplied to the condenser 23 via a conduit 25 from a source 27, cools the compressed ammonia and non-condensibles in the condenser 23. After having removed some heat from the compressed ammonia and non-condensibles, the water is conveyed from the condenser 23 via a conduit 29 to equipment (such equipment herein simply being referred to as cooling water return 31) designed to accommodate used cooling water. Such equipment can be a building space heater, a building water heater, another cooling water user, a cooling water collection pond or a cooling water tower, for example.

Most of the compressed ammonia supplied to the condenser 23 condenses in the condenser 23, exits the condenser 23 in a condensed state via a conduit 33 and is introduced into a receiver 35. From the receiver 35, the ammonia is conveyed via a conduit 37 into a vaporizer 39. From the vaporizer 39, the ammonia is conveyed via a conduit 41 back to the suction separator 15 thereby completing a loop or circuit of an ammonia refrigeration system.

Those skilled in the art will appreciate that the suction separator 15, the compressor 19, the condenser 23, the receiver 35 or the vaporizer 39, although represented herein as single pieces of process equipment, can be represented, and often are represented, by a plurality of like pieces, usually arranged in parallel. Furthermore, those skilled in the art will appreciate that the compressor 19 can be a single-, double- or triple-staged compressor and if multi-staged, can include inter-stage cooling.

At least a portion of the ammonia which has completed the above-described circuit of the ammonia refrigeration system is conveyed via a conduit 43 to a facility 45 for storage. The remainder combines with the ammonia being supplied to the separator 15 from the source 11 and again completes the above-described circuit.

TEMPERATURE OF CONDENSED AMMONIA

The temperature of the cooled, compressed ammonia exiting the condenser 23 is sensed in the conduit 33 and such sensed temperature information is converted into an electrical signal and conveyed via a conductor 47 to a temperature transmitter 48 which converts the electrical signal into a pneumatic signal and conveys the pneumatic signal via a conduit 49 to a pressure controller 51.

NON-CONDENSIBLES

Unless non-condensibles are vented from the circuit, they will accumulate in the circuit and the refrigeration efficiency of the circuit will accordingly be reduced. It is therefore desirable to purge the non-condensibles from the circuit.

The pressure controller 51 is used to control an automatic valve 53 for the purpose of venting non-condensibles from the circuit. Non-condensibles are conveyed from the circuit via a conduit 55, by the action of the valve 53 opening to release the non-condensibles from the condenser 23. The non-condensibles are conveyed by the conduit 55 to a collection site 57 for use, or for disposal. Some gaseous ammonia is included with the non-condensibles.

METHOD TO MAINTAIN PRESELECTED NON-CONDENSIBLE CONCENTRATION

When the above-described circuit is operating in a so-called steady-state manner, the amount of non-condensibles to be purged from the circuit will be a function of ammonia supply rate from the source 11 to the separator 15 and non-condensible concentration of such ammonia. When the rate of ammonia through the conduit 13 is fairly constant and when the percentage of non-condensibles in such ammonia does not vary appreciably, I have discovered an important method of minimizing the energy requirements of the compressor 19 used to compress the ammonia.

An operating pressure in the condenser 23, necessary to maintain a desired percentage of non-condensibles in the vapor phase in the condenser 23, is a function of the condensing temperature of the ammonia exiting the condenser 23, which, in turn, is a function of the temperature of the cooling water being supplied to the condenser 23.

Those skilled in the art will appreciate that many cooling mediums can be used, and will acknowledge that water, generally from a cooling water tower, is preferably used because of economic reasons.

In summer months, the cooling water supplied to the condenser 23 can be 95° Fahrenheit (35° Centigrade) and the temperature of the ammonia exiting the condenser 23 can be 100° Fahrenheit (37.8° Centigrade). Under these conditions, the pressure controller 51 is adjusted so that the valve 53 is used to maintain a pressure of of about 223 pounds per square inch absolute (15.68 kilograms per square centimeter absolute) in the condenser 23. In winter months, however, the cooling water supplied to the condenser 23 can be 60° Fahrenheit (15.6° Centigrade) and the temperature of the ammonia exiting the condenser 23 can be 65° Fahrenheit (18.3° Centigrade).

Assuming the rate of ammonia from the source 11 to the separator 15, and the concentration of non-condensibles in such ammonia does not change seasonally, the temperature controller 51 can be (and usually is) periodically adjusted so that a preselected concentration of non-condensible gases is maintained for gas being vented or otherwise purged from the condenser 23.

As dictated by current economics, it is desirable to maintain a concentration of about 5% for the non-condensible gases in the condenser.

When the condensing ammonia temperature is about 100° Fahrenheit (about 37.8° Centigrade), a pressure of about 223 pounds per square inch absolute (about 15.68 kilograms per square centimeter absolute) in the condenser 23 will result in about 5% concentration of non-condensibles in the vapor phase of the condenser 23. When the condensing ammonia temperature is reduced to about 65° Fahrenheit (about 18.3° Centigrade), about 124 pounds per square inch absolute (8.72 kilograms per square centimeter absolute) of pressure is required in the condenser 23 to maintain the 5% non-condensible concentration.

My method of control continuously monitors the pressure in the condenser 23 and continuously senses the temperature of the ammonia exiting the condenser 23 to maintain a preselected concentration of non-condensibles in the condenser 23. Pressure in the condenser 23 is communicated to the pressure controller 51 via a conduit 59. The temperature transmitter 48 translates the sensed temperature signal (received via the conductor 47) into a corresponding pressure signal (communicated via the conduit 49) necessary to effect a precalculated pressure for the condenser 23 which, in turn, is necessary to maintain the preselected non-condensible concentration within the condenser 23. The pressure controller 51 pneumatically communicates with the valve 53, via a conduit 61, causing the valve 53 to open or close accordingly to cause the precalculated pressure to be maintained in the condenser 23. The pressure controller 51 also continuously monitors actual pressure in the condenser 23 via the conduit 59 to assure that actual pressure in the condenser 23 does not differ from the precalculated pressure desired for the condenser 23 by more than a preselected pressure differential.

EFFECT UPON THE COMPRESSOR

When pressure in the condenser 23 is reduced, resistance to flow decreases in the conduit 21 and flow through the compressor 19 accordingly increases which results in a drop in the intake pressure of the compressor 19. In addition, intake pressure of the compressor 19 will vary according to the amount of refrigeration effected in the circuit, i.e., at the vaporizer 39. Rotational speed of operation of the compressor 19 is controlled by sensing intake pressure of the compressor 19.

A compressor intake pressure sensor 63 is in pneumatic communication, via a conduit 65, with the conduit 17 supplying ammonia to the intake port of the compressor 19.

A driver 67 (for example, an electric motor) is coupled by a shaft 69 to a rotating portion (not shown) of the compressor 19. The compressor intake pressure sensor 63 converts sensed intake pressure information from a pneumatic signal into an electrical signal, which is conveyed by a conductor 71 to a shaft speed controller 73. A reduced compressor inlet pressure is sensed by the sensor 63 and is used to cause the driver 67 to reduce the rotational speed of the rotating portion of the compressor 19. To control the speed of the driver 67, the controller 73 sends an electrical signal to the driver 67 via a conductor 75. The rotational speed of the shaft 69 is continuously monitored by a shaft speed sensor 77. The shaft 69 rotational speed information is continuously communicated from the shaft speed sensor 77 to the shaft speed controller 73 via a conductor 79 to assure that the rotational speed of the rotating portion of the compressor 19 is reduced when inlet pressure to the compressor 19 is correspondingly reduced. As inlet pressure to the compressor 19 is increased, rotational speed of the shaft 69 is accordingly increased.

The practice of the above-described method of my invention has resulted in a net reduction of the energy required to drive the compressor 19 for the purpose of operating the above-described circuit in a preselected manner, in comparison to the energy required for practice of methods well known in the art.

Thus, it can be appreciated by those skilled in the art that the above-described invention is generally applicable to any close-looped, partial-recycle refrigeration system using a condensible gas (such as sulfur dioxide, propane, freon, methyl chloride, isobutane, or ethyl chloride, for example) which contains non-condensible gases.

What has been illustrated and described herein is a novel method of process control. While the method of the instant invention has been illustrated and described with reference to a preferred embodiment, the invention is not limited thereto. On the contrary, alternatives, changes or modifications may become apparent to those skilled in the art upon reading the foregoing description. Accordingly, such alternatives, changes or modifications are to be considered as forming a part of the invention insofar as they fall within the spirit and scope of the appended claims.

I claim:

1. In a refrigeration system having a controller and a condenser, said condenser having a valve controllable to open at different pressures, said system including means for controlling a preselected concentration of non-condensible gases, said condenser receiving predetermined rates of said non-condensible gases and a condensible gas in a predetermined ratio in relation to said non-condensible gases, said valve being usable selectively to purge at least a portion of said non-condensible gases from said system, said condenser including means for condensing at least a portion of said condensible gas and thereby forming condensate within said condenser, pressure within said condenser being controllable by said valve, a method for maintaining said preselected concentration of said non-condensible gases in said condenser comprising: (1) sensing the temperature of said condensate to determine a sensed temperature value; (2) converting said sensed temperature value into a first signal receivable by said controller and convertible by said controller into a second signal, said controller including means for using said second signal to cause said valve to function in a predetermined manner to open at a controlled pressure to cause said actual pressure in said condenser to change to a new actual pressure corresponding to a precalculated pressure value corresponding to said sensed temperature for maintaining said preselected concentration of said non-condensible gases in said condenser; and (3) comparing said new actual pressure to said precalculated pressure value and adjusting said valve until the differential between said new actual pressure and said precalculated pressure value is no more than a preselected differential.

2. The method of claim 1 wherein said condensible gas is ammonia.

3. The method of claim 2 wherein said non-condensible gases are selected from the group consisting of nitrogen, methane, hydrogen, argon, helium and mixtures thereof.

4. In a refrigeration system as set forth in claim 1 and further having a compressor with a rotary drive, the further step of sensing the pressure of gases entering said compressor, and utilizing the pressure so sensed to vary the speed of said compressor drive.

5. In a process having a condenser and a compressor powered by an energy source for supplying compressed ammonia to said condenser, said compressed ammonia including non-condensible gases, at least a portion of said compressed ammonia forming condensed ammonia and exiting said condenser, and means for maintaining pressure in said condenser at a predetermined maximum pressure value, said process including means for purging at least a portion of said non-condensible gases from said condenser, wherein the improvement comprises means for maintaining substantially a preselected concentration of said non-condensible gases within said condenser comprising: (1) means for sensing the temperature of said condensed ammonia at a point in time to determine a corresponding sensed condensed ammonia temperature value, a new sensed temperature value being generated as the temperature of said condensed ammonia changes over time; (2) means for converting said condensed ammonia temperature value into a first signal; (3) means for converging said first signal into a precalculated condenser pressure value corresponding to said preselected concentration of non-condensible gases; (4) means for sensing pressure within said condenser to determine an actual condenser pressure value; (5) means for converting said actual condenser pressure value into a second signal; (6) means for comparing said second signal to said first signal thereby generating an error signal; (7) means for suing said error signal controllably to open a purge valve at different pressures and thereby to change actual pressure in said condenser to a pressure corresponding to said precalculated condenser pressure value determined at said new sensed temperature value, for maintaining pressure in said condenser at less than said predetermined maximum value while maintaining substantially said preselected concentration of said non-condensible gases thereby effecting over a period of time a net energy use reduction for said energy source.

6. Means for maintaining a preselected concentration of non-condensible gases in a condenser having a valve controllably openable at different pressures and receiving a predetermined rate of said non-condensible gases and a predetermined ratio of condensible gas in relation thereto, said condenser including means for condensing said condensible gas and thereby forming condensate therein, actual pressure within said condenser being controllable by a controller and said valve, comprising: (1) means for sensing the temperature of said condensate to detemine a sensed temperature value; (2) means for converting said sensed temperature value into a signal receivable by said controller and convertible by said controller into a signal communicable by said controller to cause said valve to function in a predetermined manner to open at controllably different pressures and thereby to cause said actual pressure in said condenser to change to a new actual pressure corresponding to a precalculated pressure value corresponding to said sensed temperature for maintaining said preselected concentration of said non-condensible gases in said condenser; and (3) means for comparing said new actual pressure to said precalculated pressure value and adjusting said valve until the differential between said new actual pressure and said precalculated pressure value is no more than a preselected differential.

* * * * *